United States Patent [19]

Kuratani

[11] Patent Number: 4,739,300

[45] Date of Patent: Apr. 19, 1988

[54] ROTARY TYPE ELECTRONIC PART

[75] Inventor: Junichi Kuratani, Miyagi, Japan

[73] Assignee: Alps Electric Co., Ltd., Japan

[21] Appl. No.: 929,334

[22] Filed: Nov. 10, 1986

[30] Foreign Application Priority Data

Nov. 14, 1985 [JP] Japan ..... 60-174164

[51] Int. Cl.[4] ..... H01C 10/32

[52] U.S. Cl. ..... 338/162; 338/166; 338/168

[58] Field of Search ..... 338/128, 129, 132, 133, 338/138, 162, 174, 166, 168

[56] References Cited

U.S. PATENT DOCUMENTS 3,997,865 12/1976 George ..... 338/174

4,035,759 7/1977 Van Benthuysen ..... 338/162

4,109,230 8/1978 Frey, Jr. ..... 338/162 X

*Primary Examiner*—E. A. Goldberg

*Assistant Examiner*—M. M. Lateef

*Attorney, Agent, or Firm*—Guy W. Shoup

[57] ABSTRACT

A rotary type electronic device has a stationary casing and an axially slidable and angularly rotatable shaft disposed in the casing. The end of the shaft is assembled to the end face of a detentable (heart-shaped) cam so that the shaft can be pushed axially to engage and disengage from a detent position within the casing. The end of the shaft is formed with a tapered conical tip portion, and the end face of the cam is formed with a central insertion hole, having a diameter smaller than the outer diameter of the conical tip portion, and with cutout portions on opposite sides adjacent the insertion hole forming deformable bridging portions therebetween which deform to allow insertion of the conical tip portion of the shaft in a direction perpendicular to the end face.

2 Claims, 5 Drawing Sheets

ROTARY TYPE ELECTRONIC PART

BACKGROUND OF THE INVENTION

1. Field of the Invention

The present invention relates to rotary type electronic parts such as rotary type variable resistors and rotary switches.

2. Description of the Prior Art

As an example of volume controls, in which a heart-shape cam and a variable resistor are combined and reciprocating operation of its operating shaft and rotational operation of its sliding member are enabled, there is for example one as indicated in FIG. 6.

FIG. 6 is a cross-sectional view of a rotary type variable resistor (hereinafter to be referred to as a volume) of the prior art. Referring to the drawing, the volume control primarily consists of a variable resistor portion 1, cam portion 2, and an operating shaft 4 which passes through the variable resistor portion 1 and engages with a heart-shape cam member 3 (hereinafter to be referred to as a heart cam) of the cam portion 2.

The variable resistor portion 1 is provided, between its front plate 5 and back plate 6, with two substrates 8*a*, 8*b*, which are provided thereon with conductive patterns 7 as devices on the stationary side, a slider retainer 10 disposed between the substrates 8*a*, 8*b* for retaining, on its surface facing the conductive patterns 7 formed on the substrate 8*a*, 8*b*, sliders 9 as devices on the rotary side in slidable contact with the mentioned conductive patterns 7, and a fastening plate 12 engaged with an axial portion 10*a* of the slider retainer 10 for transmitting rotation of the operating shaft 4 thereto and, at the same time, supporting an annular plate spring 11 for providing rotating torque, and these are integrated by pins, not shown, passed therethrough and caulked, with the distance between the substrates 8*a*, 8*b* regulated by the side plates 13*a*, 13*b*. Denoted by 14 are terminals connected with the conductive patterns 7.

The cam portion 2 consists of a housing 15, front plate 16 on the side of the variable resistor portion 1, heart cam 3 housed in the housing 15 and normally urged in the direction of the front plate 16 by a spring 17, engagement pin 18 projecting from the side of the front plate 16, the tip of the engagement pin 18 being adapted to move along a cam groove 20 of the heart cam 3, and a plate spring 19 elastically pressing the engagement pin 18 in the direction of the cam groove 20.

The heart cam 3 is provided with a cam groove 20 cut in the undersurface, and it is adapted such that a predetermined reciprocating motion of the operating shaft 4 is completed by means of a stepped portion provided in the cam groove 20 while the tip of the engagement pin 18 makes a round of the cam groove 20. In the end face of the heart cam 3, there is cut an engagement groove 21 with which the groove portion 4*a* at the tip of the operating shaft 4 is adapted to elastically engage as shown in FIG. 8, and the inlet side for the engagement opens on the groove 16*a* cut in the front plate 16.

With the volume as structured above, the position indicated in FIG. 4 is where the operating shaft 4 is rotatable. After the volume is adjusted to a desired volume level there, if the operating side 4*b* of the operating shaft 4 is pushed in the direction indicated by the arrow A, the tip portion 18*a* of the engagement pin 18 is introduced into the cam groove 20 from the position B through the inlet portion 20*a* of the cam groove 20.

The tip then moves along the inward passage 20*b* of the cam groove 20 in the direction indicated by the arrow C, and when the push is released after the operating shaft 4 has been pushed a full stroke, the same moves along the passage indicated by the arrow D and reaches the engagement position E and the heart cam 3 stops at this position E, whereby the operating shaft 4 also stops in the position as pushed in toward the front plate 5. As a result, operating parts provided on the operating side 4*b* of the operating shaft 4 such as a knob are received within the main body, and so, the knob and other parts can be put out of the way while the same are not in use. If the operating side 4*b* of the operating shaft 4 is pushed in from this position, the tip portion 18*a* of the pin 18 moves in the direction as indicated by the arrow F, and when the push is released, the same moves along the outward passage 20*c* in the direction indicated by the arrow G and returns to the position B through the inlet portion 20*a*, whereby the heart cam 3 restores the position indicated by FIG. 6 to enable the rotary operation of the operating shaft 4. Incidentally, FIG. 9 shows that the tip portion 18*a* of the pin 18 would move about, but, of course, this is just for explanation; in reality, the tip portion 18*a* of the pin 18 is only allowed to swing about the fitted position 18*b* of the pin 18 in the direction perpendicular to the surface of the paper of FIG. 7, and so, the heart cam 3 makes the reciprocating movement with reference to the pin 18 to perform the above described function.

In the case where the volume structured as described above is assembled, the variable resistor portion 1 and the cam portion 2 are separately assembled in advance. Thereafter, the groove portion 4*a* of the operating shaft 4 projecting out of the variable resistor portion 1 is put in engagement with the engagement groove 21 of the heart cam 3, and then the variable resistor portion 1 is integrated with the cam portion 2 by means of pins or the like, not shown, and thus the assembling is finished. More particularly, the mentioned groove portion 4*a* is inserted into the groove 16*a* cut in the front plate 16 from above at an angle, as indicated in FIG. 7, in the direction indicated by the arrow I, so that the same is inserted into the engagement groove 21 of the heart cam 3 and put in elastic engagement with the engagement groove 21. At this time, since the spring 17 is abutting on the rear side of the heart cam 3, the insertion must be made while the spring 17 is pushed back. This engagement is effected by elastic deformation of the end face portion of the heart cam 3 in the circumferential direction.

The volumes structured as above, however, are more frequently used for small-sized apparatus as car audio equipment, for example, and so, the component parts for such a volume becomes still smaller. Therefore, there was a problem of deteriorated efficiency in the assembly work by the employment of the described assembling method, in which the groove 4*a* has to be inserted into the engagement groove 21 from above at an angle with the spring 17 pushed back.

SUMMARY OF THE INVENTION

The present invention was made in view of the above described problem of the prior art, and a primary object of the invention therefore is the provision of a rotary type electronic part with a heart cam used therein which will be assembled at improved efficiently.

To solve the above mentioned problem, the present invention, in a rotary type electronic part having an operating shaft provided, at its tip portion, with a cam portion including a heart-shape cam member in which a groove in a loop shape is cut with a stepped portion provided therein, devices on the rotary side rotating in association with an operating shaft, and devices on the stationary side slidably put in contact with the devices on the rotary side, and enabling the operating shaft to make reciprocating movement in the axial direction and rotary movement in the circumferential direction, is provided in the end face of the heart shaped cam member with an insertion portion of elastic structure such that the operating shaft can be pushed thereinto in the direction perpendicular to the end face and provided in the operating shaft with an engagement groove such that the operating shaft after being pushed in becomes unable to come off by elastic structure of the insertion portion.

According to the above described structure, the cam portion and the main body including the devices on the stationary side and devices on the rotary side are separately assembled in advance, and then the operating shaft projecting out of the main body is pushed from the end face side of the heart cam of the cam portion into the insertion portion formed in the end face of the heart cam, whereby the engagement groove of the operating shaft is put in elastic engagement with the insertion portion. Thus, the operating shaft can be readily attached to the heart cam by so-called snap-in structure.

BRIEF DESCRIPTION OF THE DRAWINGS

FIGS. 1 to 5 are for explanation of one embodiment of the present invention, wherein FIG. 1 is a cross-sectional view of main portion of a volume according to the invention;

FIG. 2 is a front view of a heart cam;

FIG. 3 is a rear view of the same;

FIG. 4 is a cross-sectional view of main portion of the same; and

FIG. 5 is an enlarged view of main portion of an operating shaft.

FIGS. 6 to 10 are for explaining the prior art, wherein FIG. 6 is a cross-sectional view of main portion of a volume according to the prior art;

FIG. 7 is an enlarged cross-sectional view of a cam portion;

FIG. 8 is a front view of a heart cam;

FIG. 9 is a plan view showing operation of the heart cam; and

FIG. 10 is a front view of the cam portion on the side of the front plate.

DESCRIPTION OF THE PREFERRED EMBODIMENT

One preferred embodiment of the present invention will be described in the following with reference to the accompanying drawings.

Figure 1:
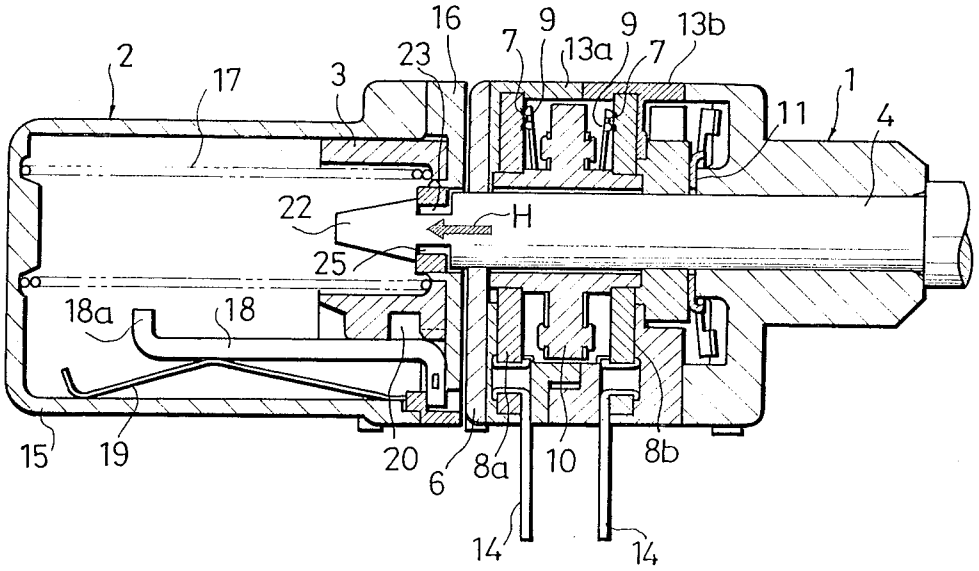
Figure 2:
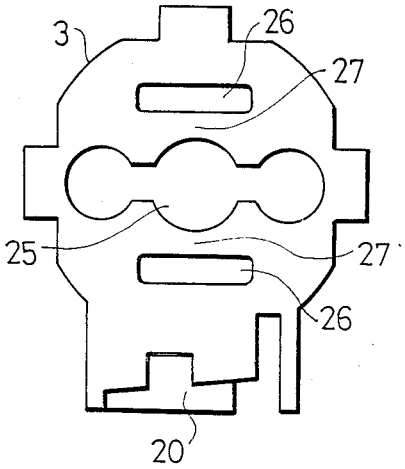
Figure 3:
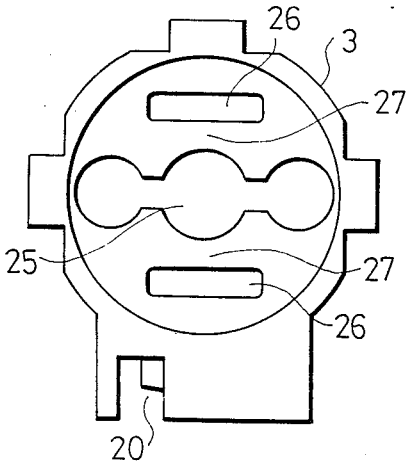
Figure 4:
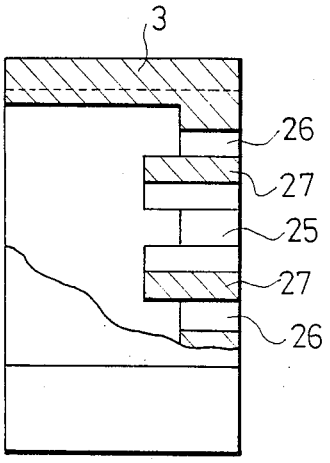
Figure 5:
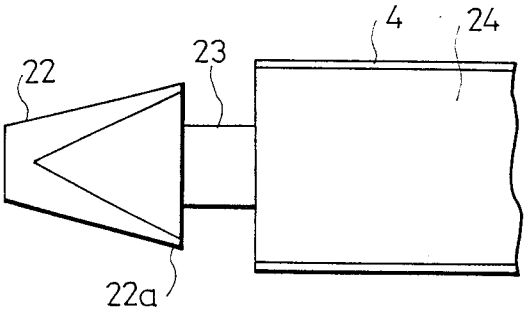
Figure 6:
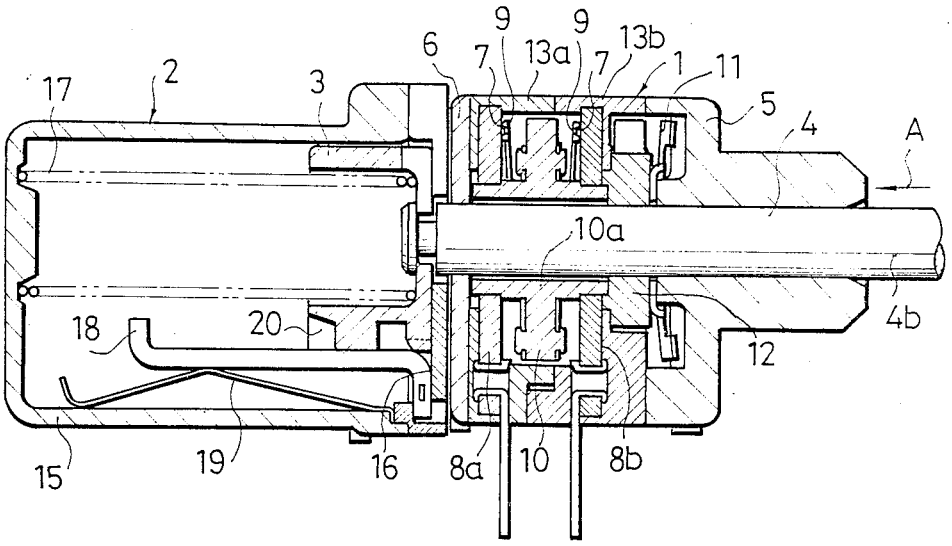
Fig. 6 PRIOR ART
Figure 7:
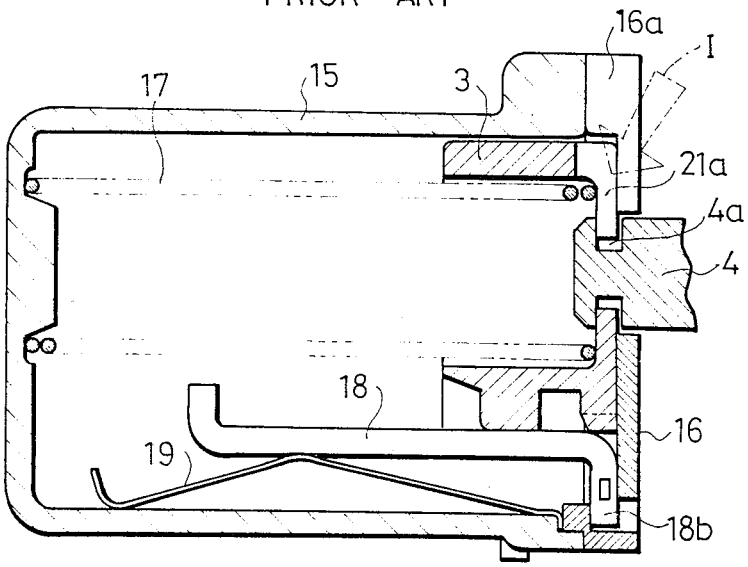
Fig. 7 PRIOR ART
Figure 8:
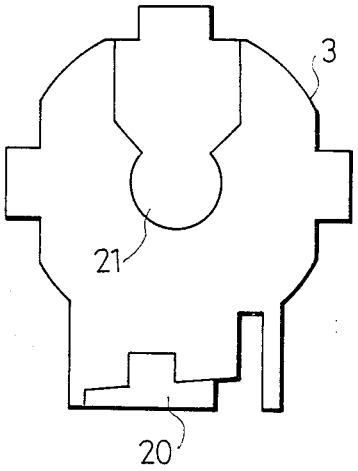
Fig. 8 PRIOR ART
Figure 9:
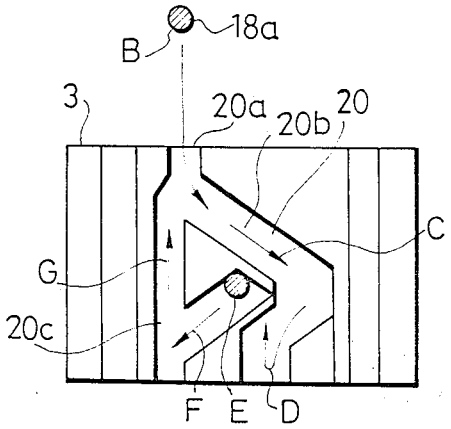
Fig. 9 PRIOR ART
Figure 10:
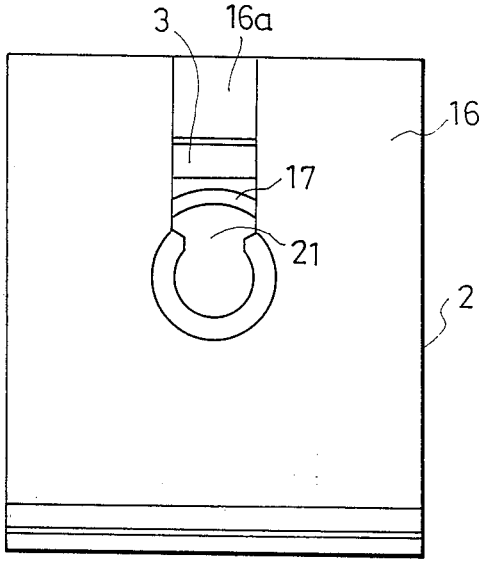
Fig. 10 PRIOR ART

FIGS. 1 to 5 are for explanation of the embodiment of the invention, wherein FIG. 1 is a cross-sectional view of main portion of a volume according to the invention, FIG. 2 is a front view of a heart cam, FIG. 3 is a rear view of the same, FIG. 4 is a cross-sectional view of main portion of the same, and FIG. 5 is an enlarged view of main portion showing the insertion side of an operating shaft. Referring to the drawings, the parts that are the same as or regarded as the same as those in the prior art are denoted by the same reference numerals.

Referring to FIG. 5, the operating shaft 4 is formed substantially into a conical shape at its tip portion 22 on the side of the cam portion 2, and the conical tip portion is provided with a shoulder portion **22*a* at its base and an engagement groove 23 adjoining thereto. The same is provided at its shaft portion with an engagement portion 24 in a flat form for engaging with the slider retainer 10 and fastening plate 12 for rotating the slider retainer 10 and fastening plate 12**.

In the end face of the heart cam 3 on the side of the variable resistor portion 1, as shown in FIGS. 2, 3, and 4, there is provided an insertion portion 25 into which the tip portion 22 of the operating shaft 4 can be inserted. The insertion portion 25 is formed to be like a groove, and in the center thereof, there is provided a substantially circular portion into which the substantially conical portion of the tip portion 22 is to be pushed. On both sides of the insertion portion 25, there are provided two groove portions 26 cut therein, whereby bridging portions 27 are formed between the insertion portion 25 and the groove portions 26, and the bridging portions 27 are adapted to deform elastically. Other parts which have not been described in particular are arranged the same as in the prior art, and so, explanation about the same will be omitted here.

With above described structure, if, after separately assembling the variable resistor portion 1 passed through by the operating shaft 4 and the cam portion 2 provided with the heart cam 3, the tip portion 22 of the operating shaft 4 is pushed into the insertion portion 25 in the direction (indicated by the arrow H) perpendicular to the end face of the heart cam 3, then the bridging portion 27 deforms in the direction of the groove portion 26 and, when the shoulder portion **22*a* rides across the bridging portion 27, the bridging portion 27 returns to its original shape by its own elasticity and thus engages with the engagement groove 23. Once the bridging portion 27 has returned to the side of the engagement groove 23 and the engagement groove 23 and the bridging portion 27 have been put in engagement, it becomes practically impossible to release the engagement, and the engagement of the operating shaft 4 with the heart cam 3** is thus maintained substantially completely.

Therefore, the tip portion 22 of the operating shaft 4 can be pushed into the insertion portion 25 just by holding the tip portion 22 against the insertion portion 25 and pushing the same in the axial direction (in the same direction as the operating direction of the operating shaft 4), and thus, the heart cam 3 can be readily attached to the operating shaft 4 by snap-in structure.

According to the present invention, as described so far, there is provided an insertion portion which can be elastically deformed in the radial direction in the end face of the heart cam, and by pushing the operating shaft thereinto in the direction perpendicular to the end face, the engagement groove of the operating shaft can be engaged with the insertion portion, and the heart cam can readily be attached to the operating shaft, and therefore, such an effect is obtained that efficiency in the assembling work of the rotary type electronic parts of this type can be considerably improved.

What is claimed is:

1. In a rotary type electronic device having a stationary casing and an axially slidable and angularly rotatable operating shaft having one end disposed for axially sliding movement along a longitudinal direction in the casing, a detentable cam disposed in the casing having a slidable portion with an end face perpendicular to the longitudinal direction which is engaged by the one end of the operating shaft such that the shaft can be slid axially inwardly and outwardly of the casing to engage and disengage from a detent position of the cam in the casing, the improvement wherein said one end of the shaft is formed with a conical tip portion, tapered in the inward longitudinal direction from an outer diameter side to an inner diameter side, and with a retaining circumferential groove formed outwardly of said outer diameter side, and wherein said end face of the cam is formed with a central hole for inserting and retaining said one end of the operating shaft, said hole having a diameter larger than the inner diameter and smaller than the outer diameter of the conical tip portion, and with cutout portions on opposite sides adjacent to the central hole forming deformable bridging portions therebetween which elastically deform to allow insertion of the conical tip portion of the shaft in a direction perpendicular to the end face during assembly and which thereafter remain engaged with the retaining groove of the operating shaft.

2. A rotary type electronic device of claim 1, further comprising a rotary variable resistor unit disposed outwardly of the casing having a central opening through which said operating shaft is axially slidably received, said resistor unit having a stationary conductive pattern part in the unit and a rotary slider part engaged with the operating shaft such that rotation of the shaft is used to make sliding electrical contact between the slider part and the conductive pattern part.

* * * * *